US009387474B2

(12) United States Patent
Ettlin

(10) Patent No.: US 9,387,474 B2
(45) Date of Patent: Jul. 12, 2016

(54) APPARATUS FOR ANALYZING A TEST LIQUID

(71) Applicant: SULZER MIXPAC AG, Haag (CH)

(72) Inventor: Josef Ettlin, Eichberg (CH)

(73) Assignee: SULZER MIXPAC AG, Haag (CH)

( * ) Notice: Subject to any disclaimer, the term of this patent is extended or adjusted under 35 U.S.C. 154(b) by 0 days.

(21) Appl. No.: 14/766,988

(22) PCT Filed: Feb. 10, 2014

(86) PCT No.: PCT/EP2014/052563

§ 371 (c)(1),
(2) Date: Aug. 11, 2015

(87) PCT Pub. No.: WO2014/124905

PCT Pub. Date: Aug. 21, 2014

(65) Prior Publication Data

US 2016/0001286 A1 Jan. 7, 2016

(30) Foreign Application Priority Data

Feb. 12, 2013 (EP) ..... 13154869

(51) Int. Cl.
*B01L 3/00* (2006.01)

(52) U.S. Cl.
CPC ..... *B01L 3/5023* (2013.01); *B01L 3/502* (2013.01); *B01L 3/5029* (2013.01); *B01L 2200/025* (2013.01); *B01L 2200/028* (2013.01); *B01L 2200/0621* (2013.01); *B01L 2200/10* (2013.01); *B01L 2300/042* (2013.01); *B01L 2300/069* (2013.01); *B01L 2300/0663* (2013.01); *B01L 2300/087* (2013.01); *B01L 2300/0832* (2013.01); *B01L 2400/0644* (2013.01)

(58) Field of Classification Search
CPC ..... B01L 2200/025; B01L 2200/028; B01L 2200/0621; B01L 2200/10; B01L 2300/042; B01L 2300/0663; B01L 2300/069; B01L 2300/0832; B01L 2300/087; B01L 2400/0644; B01L 3/502; B01L 3/5023; B01L 3/5029
See application file for complete search history.

(56) References Cited

U.S. PATENT DOCUMENTS

| | | | | |
|---|---|---|---|---|
| 6,277,646 | B1 | 8/2001 | Guirguis et al. | |
| 2005/0084842 | A1 * | 4/2005 | O'Connor | A61B 10/0045 435/4 |
| 2006/0292034 | A1 | 12/2006 | Gould et al. | |

FOREIGN PATENT DOCUMENTS

| | | | |
|---|---|---|---|
| DE | 202008017883 | U1 | 11/2010 |
| WO | 2009/036168 | A2 | 3/2009 |
| WO | 2011/018658 | A1 | 2/2011 |

* cited by examiner

*Primary Examiner* — Sally Merkling
(74) *Attorney, Agent, or Firm* — Global IP Counselors, LLP

(57) ABSTRACT

An apparatus includes an inlet chamber, a preparation chamber, an analysis element and a housing with an inner housing space in which a preparation element bounding the preparation chamber and an inlet element bounding the inlet chamber are arranged. The test strip is arranged in the housing so as to be visible from the outside. Test liquid can be brought from the inlet chamber via the preparation chamber onto the analysis element. The inner housing space is of cylindrical design and the preparation element is capable of being rotated with respect to the inlet element and the housing. Thus, a compact housing is possible, in particular, a compact housing with a cylindrical or parallelepiped-shaped outer contour.

16 Claims, 3 Drawing Sheets

APPARATUS FOR ANALYZING A TEST LIQUID

CROSS-REFERENCE TO RELATED APPLICATIONS

This application is a U.S. National stage application of International Application No. PCT/EP2014/052563, filed Feb. 10, 2014, which claims priority to EP Application No. 13154869.5 filed on Feb. 12, 2013, the contents of each of which is hereby incorporated herein by reference.

BACKGROUND

1. Field of Invention

The invention relates to an apparatus for analyzing a test liquid.

2. Background Information

Such apparatus can be used, for example, for analyzing saliva or urine of a test person. It is, however, also possible that other liquids are analyzed or a sample substance to be analyzed, for example in the form of a solid, is first mixed with a so-called washing-out liquid or is dissolved therein and the test liquid obtained in so doing is subsequently analyzed. The analysis can be used, for example, for the detection of drugs, explosives or other substances such as traces of nuts.

In such analyses, the sample substance, for example in the form of saliva, is first mixed with the washing-out liquid so that a test liquid arises which can be analyzed. The mixture is in particular achieved such that a sample collector with which the sample substance can be received is washed out in the washing-out liquid. The test liquid is subsequently usually prepared. For this purpose, the test liquid can be brought into connection with a reaction partner, for example in the form of gold conjugate. The preparation is also called a so-called incubation. After a fixed waiting period, the test liquid thus prepared is conducted to an analysis element which, for example, contains a test strip which is also called a so-called lateral flow assay. The test strip is acted on at one end by a test liquid which then flows through the test strip and collects in a collection path at the oppositely disposed end of the test strip. The test strip can have a nitrocellulose membrane on which test lines and control lines are arranged which react with the test liquid and on which a reaction and thus the analysis result can be read off. The analysis result can, for example, be read of by means of a special electronic evaluation apparatus and processed.

An apparatus for analyzing a test liquid is described in US 2006/0292034 A1. The apparatus has an inlet chamber, a preparation chamber and an analysis element having a test strip. The apparatus moreover has a housing with an inner housing space in which a preparation element at least partly bounding the preparation chamber and an inlet element at least partly bounding the inlet chamber are arranged. The test strip is arranged in the housing such that it is at least partly visible from the outside. The test liquid in the form of saliva of a test person can be received by a sample collector and introduced into the inlet chamber. The sample collector is in this respect pressed out so that test liquid enters into the inlet chamber. The inlet chamber is displaced in the direction of the preparation chamber arranged beneath it by pressing the sample collector onto the base of the inlet chamber. The inlet chamber is displaced so far until the base of the inlet chamber tears and thus a not precisely defined quantity of the test liquid flows from the inlet chamber into the preparation chamber. After a fixed incubation time of approximately 2-3 minutes, a slider arranged between the preparation chamber and the test strip is opened so that the prepared test liquid can move onto an end of the test strip. After a reaction time, the analysis result can be read off on the test strip as described above. An opening of the inlet element is in this respect arranged perpendicular to the test strip.

An apparatus for analyzing a test liquid is likewise described in DE 20 2008 017 883 U1. The apparatus has a preparation chamber in the form of a mixing chamber and an analysis element having a test strip. On the utilization of the apparatus, test liquid is filled from a separate washing-out apparatus into the preparation chamber from where it is conducted onto the test strip after the preparation. So that a specific quantity of test liquid is filled into the preparation chamber, it has a filling level marking up to which a user of the apparatus should fill in test liquid. A monitoring or checking of the actually filled-in quantity of test liquid is not possible.

SUMMARY

Against this background, it is the object of the invention to propose an apparatus for analyzing a test liquid which is of a very compact design. This object is satisfied in accordance with the invention by an apparatus for analyzing a test liquid as disclosed herein.

The apparatus in accordance with the invention for analyzing a test liquid has an inlet chamber, a preparation chamber and an analysis element. The apparatus moreover has a housing with an inner housing space in which a preparation element at least partly bounding the preparation chamber and an inlet element at least partly bounding the inlet chamber are arranged. The test strip is arranged in the housing such that it is at least partly visible from the outside. The inlet chamber is provided to receive the test liquid. Test liquid can be brought from the inlet chamber via the preparation chamber onto the analysis element.

In accordance with the invention, the inner housing space is of cylindrical design and the preparation element can be rotated with respect to the inlet element and the housing. It is thus possible to design the housing in a very compact manner, in particular with a cylindrical or parallelepiped-shaped outer contour. The apparatus is moreover simple and reliable to handle since the different positions of the individual components with respect to one another which are required for the analysis can be set by a simple rotation of the preparation element with respect to the inlet element and the housing.

The analysis element in particular has one or more test strips which are arranged in the axial direction of the housing.

In an embodiment of the invention, the preparation element and the inlet element each have a predominantly hollow cylindrical basic shape and the inlet element is arranged within the preparation element. The housing, the preparation element and the inlet element are configured and arranged such that, in a starting position, the inlet chamber and the preparation chamber are separate from one another. By rotating the preparation element with respect to the inlet element, a filling position can be set in which the preparation chamber is connected to the inlet chamber and is separate from the analysis element. An analysis position can be set by rotating the preparation element with respect to the housing, in which analysis position the preparation chamber is connected to the analysis element. A particularly compact design of the apparatus and a particularly simple handling are thus possible.

The rotation of the preparation element from the starting position into the filling position and further into the analysis position in particular only takes place in one direction of rotation. It is possible that latches are provided between the housing and the actuation element for the secure setting of the different positions, said latches fixing the actuation element in the individual positions, but being able to be overcome by pressing. For this purpose, the actuation element can have one or more cut-outs and the housing can have correspondingly positioned elevated portions. The latches can also be provided between the housing and a component connected to the preparation element with which, for example, a force for rotating the preparation element can be introduced.

In an embodiment of the invention, the inlet chamber is separate from the analysis element in the analysis position. It is thus prevented that further test liquid can still continue to flow during or after the preparation and can thus influence the analysis result.

In an embodiment of the invention, the inlet element and the housing are rotationally fixedly connected to one another. Only a rotation of the preparation element is thus necessary for setting the different positions. A simple design and a simple handling of the apparatus are thus made possible.

In an embodiment of the invention, starting from the filling position, a preparation position in which the preparation chamber is separate from the inlet chamber and the analysis element can be set by a further rotation of the preparation element with respect to the housing before reaching the analysis position. Further test liquid is thus prevented from continuing to flow during or after the preparation and can thus influencing the analysis result. Accordingly, exact analyses is possible.

In an embodiment of the invention, the inlet chamber has at least one passage in the direction of the preparation element and the preparation chamber is configured as a throughgoing cut-out in the preparation element. This makes a very simple and inexpensive design of the apparatus possible.

There is in particular only a connection between the passage of the inlet chamber and the preparation chamber in the filling position. Test liquid is thus prevented, on the one hand, from unintentionally moving into the preparation chamber in the starting position and, on the other hand, further test liquid is prevented from continuing to flow during or after the preparation and can thus influencing the analysis result. Accordingly, exact analyses is possible.

The cut-out of the preparation element can be positioned by rotating the preparation element from the starting position with respect to the inlet element and thus with respect to the inlet chamber so that the cut-out is flush with the named passage of the inlet chamber and is thus connected to the inlet chamber. This is the case in the filling phase in which then the cut-out and thus the preparation chamber fills with test liquid from the inlet chamber. The inlet chamber and the preparation chamber are configured such that the preparation chamber is completely filled. Since the cut-out has a defined size, the preparation chamber contains a defined quantity of test liquid after the filling. This ensures a defined preparation of the test liquid and thus an exact analysis result.

If the analysis element has more than one test strip, a separate passage of the inlet chamber and a separate cut-out of the preparation element and thus a separate preparation chamber are in particular present for every test strip. It is thus possible in an advantageous manner to be able to prepare the test liquid differently in the different preparation chambers. For this purpose, for example, different reaction partners can be contained in the different test chambers.

After the filling, the inlet element is further rotated until the analysis position is reached in which the cut-out of the inlet element is no longer flush with the passage of the inlet chamber.

In an embodiment of the invention, the apparatus has a plug which can be inserted into an opening of the preparation element. A force for rotating the preparation element can be introduced via the plug. It is thus possible, on the one hand, to close the inlet chamber in a starting state of the apparatus and thus to prevent a contamination of the inlet chamber which could falsify the analysis result. A starting state of the apparatus is to be understood in this connection as an unused state, that is the state before the start of an analysis of a sample substance or of a test liquid. In addition, the plug can additionally be used to set the different positions of the preparation element required for the analysis of the test liquid.

In an embodiment of the invention, the plug and the named opening of the preparation element have corresponding cross-sections in the form of a so-called curve of constant width. The plug and the opening are in particular designed as conical in the axial direction. This has the result on the insertion that the plug is automatically centered in the opening. The plug can thus be very simply inserted into the opening and a good force transmission from the plug onto the preparation element is nevertheless ensured.

A curve of constant width is a closed line which always contacts all four sides in any position within a suitable square. The cross-section can also be called a so-called harmonic polygonal section having a so-called continuous P3 form curve.

In an embodiment of the invention, the plug has a sample collector. Only a few parts are thus required for the apparatus.

In an embodiment of the invention, the plug has a storage cylinder. The storage cylinder contains washing-out liquid in the starting state of the apparatus. The washing-out liquid can thus only be filled into the inlet chamber when it is really needed, without providing a separate container for the washing-out liquid. If, for example, the plug having the sample collector, is removed to take up a sample, there is not yet any washing-out liquid in the inlet chamber which could run out unintentionally.

In an embodiment of the invention, the plug has a base body having a predominantly cylindrical inner contour and an inner part immobile with respect to the base body. The inner part dips into the storage cylinder on a pushing of the storage cylinder into the base body and closes the storage cylinder in a start position. It furthermore has a connection line which is connected to the storage cylinder after leaving the start position and via which washing-out liquid can be conducted into the inlet chamber with an inserted plug. This enables the supply of the washing-out liquid into the inlet chamber in a very simple manner. For this purpose, only the storage cylinder has to be pressed in the direction of the inlet chamber and thus pushed onto the inner part. The inner part and the base body of the plug can in this respect be composed either of one part or of a plurality of parts, in particular two parts.

In an embodiment of the invention, the storage cylinder has an inwardly peripheral sealing lip at which the inner part of the base body abuts in the start position and thus closes the storage cylinder. The connection line has a radial section and an axial section which are configured such that, once the radial section has at least partly moved over the sealing lip of the storage cylinder, washing-out liquid can be pressed out of the storage chamber via the radial section into the axial section. This allows a particularly inexpensive design of the plug.

The named radial section does not have to extend exactly radially; it is sufficient if it has a radial component to the inside from one margin of the inner part so that washing-out liquid can flow from the margin of the inner part inwardly to the axial section. The axial section likewise does not have to be aligned exactly axially. It is sufficient if it is designed such that it can conduct washing-out liquid from the radial section in the axial direction in the direction of the inlet chamber. The axial section in particular extends at least partly in a shaft of the sample collection.

In an embodiment of the invention, the housing has a first cut-out through which markings on the preparation element are visible which indicate a current position of the preparation element. In addition, information can also be given on corresponding waiting times at the individual positions. A user can thus be informed simply of the current progress of the analysis and his attention can be drawn to possible waiting times which have to be observed. A secure handling and thus also reliable analysis results are thus achieved.

In an embodiment of the invention, the analysis element has at least one or more test strips, in particular two test strips, which is/are arranged in the housing and is/are visible through a second cut-out in the housing.

The individual parts of the apparatus can, for example, be composed of polyethylene or polypropylene and in particular be manufactured by means of an injection molding process.

Further advantages, features and details of the invention result with reference to the following description of embodiments and with reference to drawings in which elements which are the same or have the same function are provided with identical reference numerals.

BRIEF DESCRIPTION OF THE DRAWINGS

Referring now to the attached drawings which form a part of this original disclosure.

DETAILED DESCRIPTION OF THE EMBODIMENTS

Figure 1:
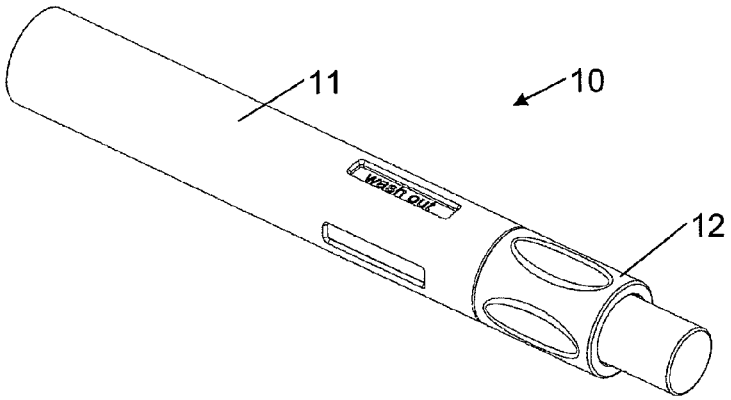
FIG. 1 is an apparatus for analyzing a test liquid in a starting state.

In accordance with FIG. 1, an apparatus 10 for analyzing a test liquid has a housing 11 which has a generally cylindrical outer contour. A plug 12 which closes an opening of the housing 11 which cannot be seen in FIG. 1 is plugged onto and partly into the housing 11. The plug 12 can be rotated with respect to the housing 11 so that different phases of the analysis can be set in which different components of the apparatus have to adopt specific positions.

Figure 2:
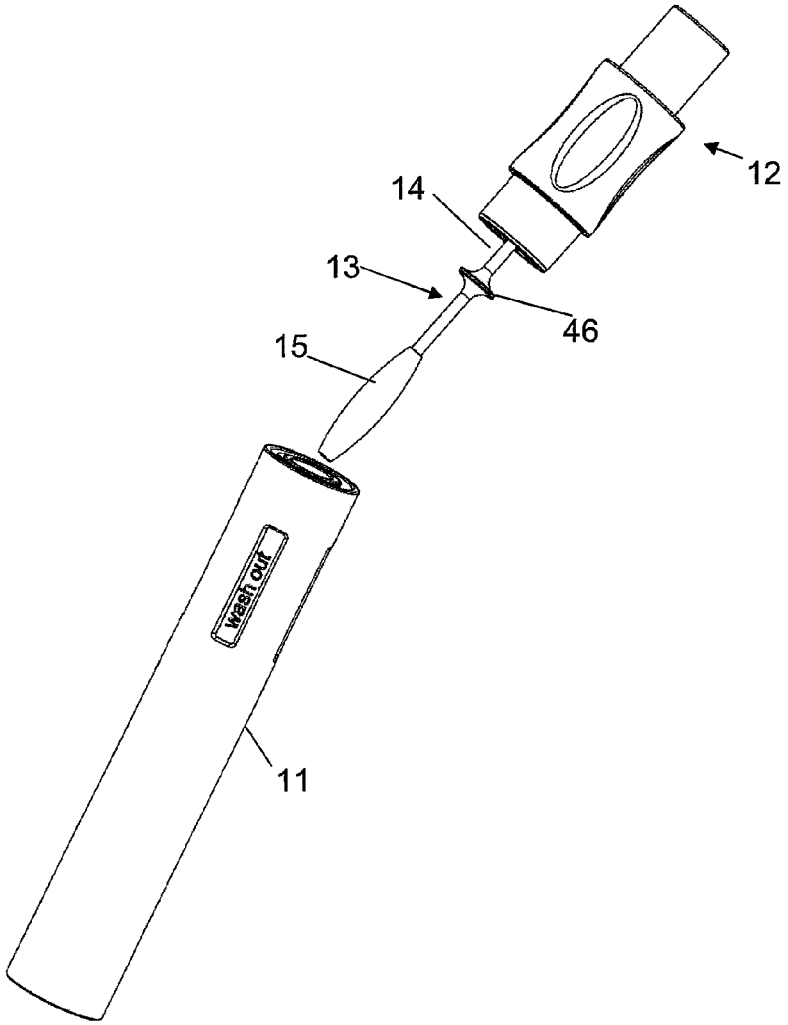
FIG. 2 shows the apparatus of FIG. 1 with a removed plug.

The plug 12 has been removed from the housing 11 in FIG. 2. The plug 12 has a sample collector 13 which is arranged within the housing 11 in the inserted state of the plug 12 in accordance with FIG. 1. The sample collector 13 has a shaft 14 and a receiving tip 15. The shaft 14 of the sample collector 13 moreover has a sealing disk 46 which serves for the sealing of an inlet chamber not shown in any more detail in FIG. 2.

Figure 3:
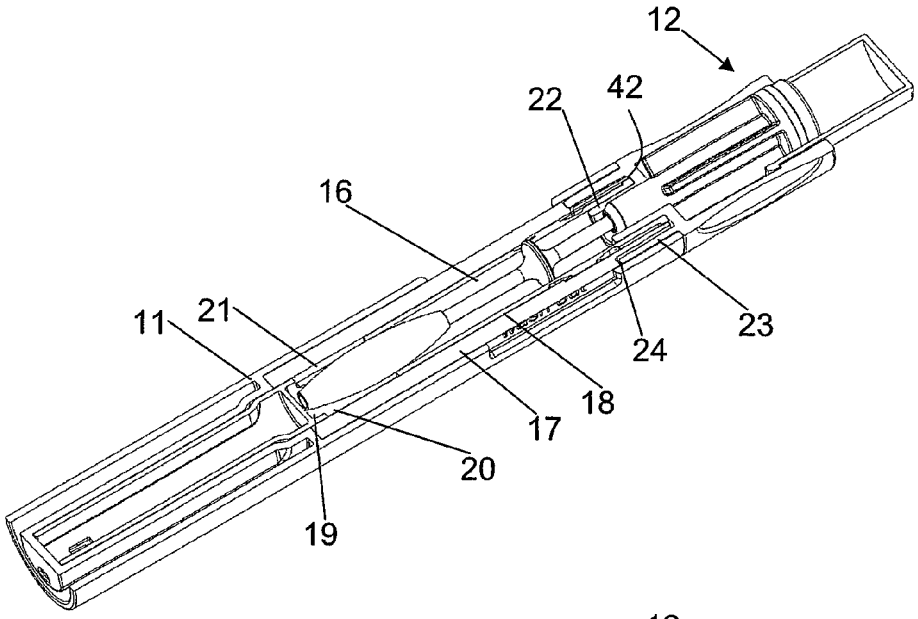
FIG. 3 shows the apparatus of FIG. 1 in a sectional representation

In accordance with FIG. 3, the housing 11 has a cylindrical inner housing space 16 in which a predominantly hollow cylindrical preparation element 17 is arranged. The preparation element 17 partly bounds two preparation chambers which are, however, only shown in any more detail in FIGS. 5, 6 and 7. A likewise predominantly hollow cylindrical inlet element 18 is arranged within the preparation element 17 and forms an inlet chamber 19 in its interior. The inlet element 18 and thus the inlet chamber 19 have two diametrically opposed passages 20, 21 in the direction of the preparation element 17. A connection between the inlet chamber 19 and the preparation chambers can be established via the two passages 20, 21 as described further below.

The plug 12, on the one hand, closes the inlet chamber 19 with an inner part 22 and, on the other hand, is inserted with an outer part 23 into an opening 42 of the preparation element 17.

The outer part 23 of the plug 12 and the opening 42 of the preparation element 17 in this respect do not have a circular cross-section, but the contour of a curve of constant width, in particular of a so-called continuous PS form curve, which cannot be seen clearly in the Figures. The outer part 23 of the plug 12 and the opening 42 are moreover only of a conical design by a few degrees in the direction of the receiving tip 15. A force can be exerted or introduced from the plug 12 onto the preparation element 17 by the named contour for rotating with respect to the inlet element 18 and the housing 11. The preparation element 17 can thus be rotated with respect to the inlet element 18 and the housing 11 by means of the plug 12. The inlet element 18 and the housing 11 are rotationally fixedly connected to one another, which is realized via a snap-in connection, not shown in any more detail, between the inlet element 18 and the housing 11.

Figure 4:
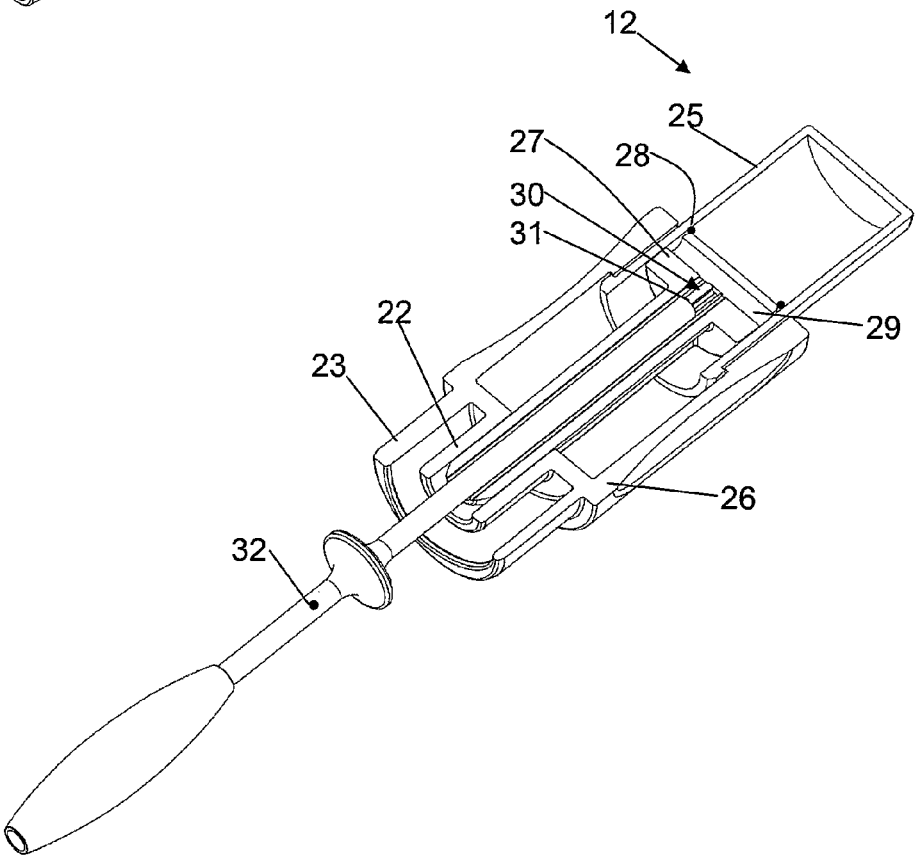
FIG. 4 is a plug with a sample collector in a sectional representation.

As shown in FIG. 4, the plug 12 has a storage cylinder 25 which contains a washing-out liquid in a starting state of the apparatus 10. The storage cylinder 25 is inserted only a little into a base body 26 of the plug 12 in the starting state of the apparatus, which corresponds to a start position of the storage cylinder 25. The base body 26 has a predominantly cylindrical inner contour which corresponds to an outer contour of the storage cylinder 25. An inner part 27 which is immobile with respect to the base body 26 and which is arranged within the storage cylinder 26 is arranged within the base body 26. The inner part 27 abuts an inner peripheral sealing lip 28 of the storage cylinder 25 in the start position of the storage cylinder 25 so that the storage cylinder 25 is sealed and no washing-out liquid can exit the storage cylinder 25.

After a sample substance, for example saliva of a test person, has been taken up by the receiving tip 15 of the sample collector 13 and the plug 12 has been placed onto the housing 11, the washing-out liquid has to be brought out of the storage cylinder 25 into the inlet chamber 19. For this purpose, the storage cylinder 25 was pressed in the direction of the housing 11 starting from its start position, whereby a radial section 29 of a connection line 30 is pushed over the sealing lip 28 and subsequently past it. Washing-out liquid can thus flow out of the storage cylinder 25 into the radial section 29 of the connection line 30, the radial section extending from radially outward to radially inward. The radial section 29 of the connection line 30 is connected to an axial section 31 of the connection line 30 which extends within the shaft 14 of the sample collector 13. The axial section 31 of the connection line 30 extends up to an exit opening 32 which lies beneath the sealing disk 46 viewed from the storage cylinder 25. Washing-out liquid can thus be brought from the storage cylinder 25 into the inlet chamber 19 by pushing or pressing the storage cylinder 25 into the base body 26 of the plug 12. The receiving tip 15 of the sample collector 13 thus dips into the washing-out liquid located in the inlet chamber 19. The received sample substance is washed out by shaking the apparatus 10. The mixture of sample substance and washing-out liquid produces a test liquid which can subsequently be analyzed.

First, a specific quantity of test liquid has to be brought into one or more preparation chambers and from there further onto an analysis element for the further analysis of the test liquid.

The steps required for this will be described with reference to FIGS. 5, 6 and 7. In these Figures, the housing 11 is shown outwardly in which two test strips 35, 36 are arranged diametrically opposite as part of an analysis element. A flowing direction of the test strips is in this respect parallel to the shaft 14 of the sample collector 13, that is in the axial direction. The preparation element 17 is arranged within the housing 11. The preparation element 17 has two diametrically opposed cutouts which form preparation chambers 33, 34. The inlet element 18 with its already described passages 20, 21 is arranged within the preparation element 17. The individual positions of the apparatus 10 shown in FIGS. 5, 6 and 7 only differ in the position of the preparation chambers 33, 34 with respect to the passages 20, 21 or to the test strips 35, 36.

Figure 5:
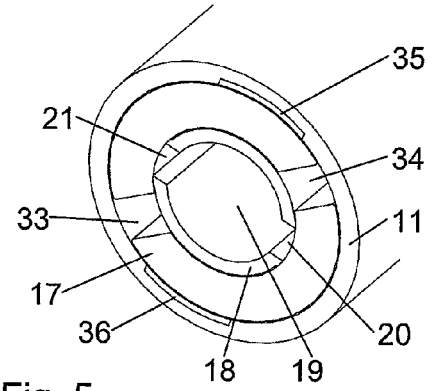
FIG. 5 is a sectional representation of the apparatus in a starting position.

In a starting position of the apparatus 10 shown in FIG. 5, the inlet chamber 19 is closed in the direction of the preparation chambers 33, 34 and of the test strips 35, 36. The preparation chambers 33, 34 are not flush with the passages 20, 21 of the inlet chamber 19.

Figure 6:
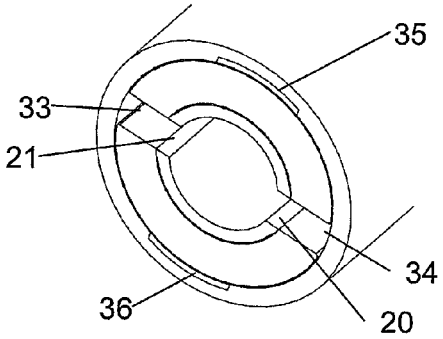
FIG. 6 is a sectional representation corresponding to FIG. 5 of the apparatus in a filling position.
Figure 7:
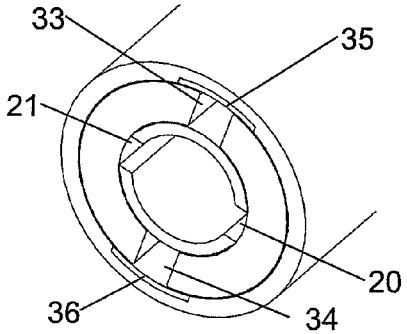
FIG. 7. is a sectional representation corresponding to FIG. 5 of the apparatus in an analysis position.

The filling position shown in FIG. 6 is set by rotating the preparation element 17 with respect to the inlet element 18 by means of the plug 12. In the filling position, the preparation chambers 33, 34 are flush with a respective one passage 20, 21 of the inlet chamber 19, but not with the test strips 35, 36. The preparation chambers 33, 34 thus fill with test liquid. So that this also takes place reliably, the apparatus 10 should be held such that the plug 12 is at the top and the shaft 14 of the sample collector is aligned as perpendicular as possible upwardly. It is then ensured that the preparation chambers 33, 34 fill completely with test liquid due to gravity and thus a respective defined quantity of test liquid is filled into the preparation chambers 33, 34 from the inlet chamber 19. A respective reaction partner, for example in the form of gold conjugate, is present in the preparation chambers 33, 34 and prepares the test liquid.

After the filling of the preparation chambers 33, 34, the preparation element 17 is rotated further into a preparation position, not shown. In the preparation position, the preparation chambers 33, 34 are, as in the starting position, neither flush with the passages 20, 21 of the inlet chamber 19 nor with the test strips 35, 36. The preparation takes a fixed period of time, for example, 4 minutes which has to be waited for.

It is not absolutely necessary that the filling position is set for a specific time. It is sufficient if the filling position is traveled over on the rotation of the preparation element 17 from the starting position into the preparation position.

After the end of the preparation, the prepared test liquid has to be brought from the preparation chambers 33, 34 onto an end of the test strips of the test strips 35, 36. For this purpose, the preparation element 17 is rotated from the preparation position into the analysis position shown in FIG. 7. In the analysis position, the preparation chambers 33, 34 are flush with the test strips 35, 36 so that prepared test liquid can moved onto the test strips 35, 36. The test liquid then flows through the test strips as described above so that the analysis results can be read off at the test strips after a fixed waiting time of, for example, 8 minutes. In the analysis position, the preparation chambers 33, 34 are not flush with the passages 20, 21 of the inlet chambers.

Figure 8:
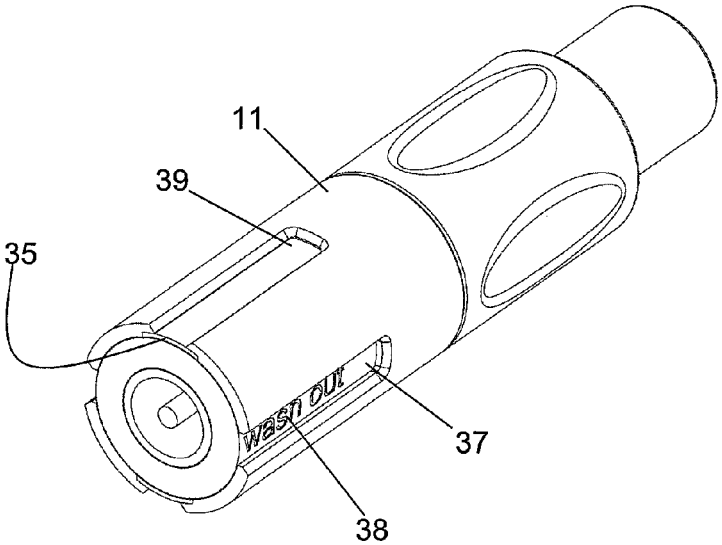
FIG. 8 is a second sectional representation of the apparatus at another axial position.

As shown in FIG. 8, the housing 11 has a first cut-out 37 through which markings 38 on the preparation element 17 are visible which indicate the current position of the preparation element 17. The indication of the position can also consist of the duration of a waiting time already described above being indicated.

The housing 11 has a second cut-out 39 which is parallel to the first cut-out 37 and is offset by 90° with respect to it and through which the test strip 35 of the analysis element is visible and thus the analysis result can be read off.

The invention claimed is:

1. An apparatus for analyzing a test liquid, comprising:
an inlet chamber;
a preparation chamber;
an analysis element;
a housing having an inner housing space;
a preparation element at least partly bounding the preparation chamber and being arranged within the inner housing space; and
an inlet element at least partly bounding the inlet chamber and being arranged within the inner housing space,
the inlet chamber being arranged to receive the test liquid,
the preparation chamber being configured to bring the test liquid from the inlet chamber onto the analysis element, and
the analysis element being arranged in the housing so as to be at least partly visible from the outside,
the inner housing space being a cylindrical design, and
the preparation element being rotatable with respect to the inlet element and to the housing.

2. The apparatus in accordance with claim 1, wherein
the preparation element has a predominantly hollow cylindrical basic shape,
the inlet element has a predominantly hollow cylindrical basic shape and is arranged within the preparation element, and
the housing, the preparation element and the inlet element are configured and arranged such that, in a starting position, the inlet chamber and the preparation chamber are separate from one another,
the preparation element being rotatable with respect to the inlet element so as to set a filing position, in which the preparation chamber is connected to the inlet chamber and is separate from the analysis element, and
the preparation element rotatable with respect to the housing so as to set an analysis position, in which the preparation chamber is connected to the analysis element.

3. The apparatus in accordance with claim 1, wherein
the inlet chamber is separate from the analysis element in the analysis position.

4. The apparatus in accordance with claim 1, wherein
the inlet element and the housing are rotationally fixedly connected to one another.

5. The apparatus in accordance with claim 1, wherein
starting from the filling position, the preparation element is further rotatable with respect to the housing so as to set a preparation position before reaching the analysis position, in which the preparation chamber is separate from the inlet chamber and the analysis element.

6. The apparatus in accordance with claim 1, wherein
the inlet chamber has at least one passage in the direction of the preparation element and the preparation chamber is configured as a throughgoing cut-out in the preparation element.

7. The apparatus in accordance with claim 6, wherein
there is only a connection between the passage of the inlet chamber and the preparation chamber in the filling position.

8. The apparatus in accordance with claim 1, further comprising a plug configured to be inserted into an opening of the preparation element and via which a force can be introduced to rotate the preparation element.

9. The apparatus in accordance with claim 8, wherein the plug and the opening of the preparation element have corresponding cross-sections in the form of a curve of constant width.

10. The apparatus in accordance with claim 8, wherein the plug has a sample collector.

11. The apparatus in accordance with claim 8, wherein the plug has a storage cylinder containing washing-out liquid in a starting state.

12. The apparatus in accordance with claim 11, wherein the plug has a base body, having a predominantly cylindrical inner contour and an inner part that is immobile with respect to the base body, being configured to dip into the storage cylinder on the pushing of the storage cylinder into the base body being configured to close the storage cylinder in a starting position, having a connection line connected to the storage cylinder after leaving the starting position and via which washing-out liquid is capable of being conducted into the inlet chamber.

13. The apparatus in accordance with claim 12, wherein the storage cylinder has an inwardly extending peripheral sealing lip at which the inner part of the base body abuts in the starting position, the connection line has a radial section and an axial section which are configured such that, once the radial section has at least partly moved over the sealing lip of the storage cylinder, washing-out liquid is capable of being pressed out of the storage chamber via the radial section into the axial section.

14. The apparatus in accordance with claim 1, wherein the housing has a first cut-out through which markings on the preparation element are visible, the markings indicating a current position of the preparation element.

15. The apparatus in accordance with claim 1, wherein the analysis element has a test strip arranged in the housing and is visible through a second cut-out in the housing.

16. The apparatus in accordance with claim 9, wherein the plug and the opening of the preparation element are of conical design in the axial direction.

* * * * *